US005334439A

United States Patent [19]

Kawaguchi et al.

[11] Patent Number: 5,334,439

[45] Date of Patent: Aug. 2, 1994

[54] IMAGE RETRANSFER SHEET FOR DRY-PROCESSING TYPE IMAGE-TRANSFER ONTO AN IMAGE RECEIVING SHEET

[75] Inventors: Takashi Kawaguchi, Aichi; Mitsuo Yamane, Yokkaichi, both of Japan

[73] Assignee: Brother Kogyo Kabushiki Kaisha, Nagoya, Japan

[21] Appl. No.: 936,649

[22] Filed: Aug. 28, 1992

[30] Foreign Application Priority Data

Sep. 2, 1991 [JP] Japan ..... 3-221647

[51] Int. Cl.[5] ..... B41M 5/26

[52] U.S. Cl. ..... 428/212; 428/195; 428/480; 428/484; 428/500; 428/913; 428/914

[58] Field of Search ..... 428/321.5, 195, 336, 428/914, 913, 403, 212, 480, 484, 500, 914, 207, 500, 520

[56] References Cited

U.S. PATENT DOCUMENTS

| | | | |
|---|---|---|---|
| 4,778,729 | 10/1988 | Mizobuchi | 428/484 |
| 4,870,427 | 9/1989 | Kobayashi et al. | 346/1.1 |
| 4,973,509 | 11/1990 | Yamane et al. | 428/195 |
| 5,114,904 | 5/1992 | Kawakami et al. | 503/227 |
| 5,217,793 | 6/1993 | Yamane et al. | 428/212 |

FOREIGN PATENT DOCUMENTS

| | | |
|---|---|---|
| 63-246298 | 10/1988 | Japan . |
| 2-81684 | 3/1990 | Japan . |
| 2-88294 | 3/1990 | Japan . |

*Primary Examiner*—Patrick J. Ryan
*Assistant Examiner*—William A. Krynski
*Attorney, Agent, or Firm*—Oliff & Berridge

[57] ABSTRACT

An image-retransfer sheet for processing dry transferring material produced by the heat-sensitive method includes a substrate, a layer of surface treating agent coated on the substrate and a layer of extended thermoplastic synthetic resin film formed on the layer of surface treating agent. An image is transferred to the image-retransfer sheet by making holes through the layer of extended thermoplastic synthetic resin film in the heat-sensitive method. In retransferring the image from the image-retransfer sheet to an image-receiving material, only the surface treating agent overlapped with the image on the image-retransfer sheet is retransferred to the image-receiving material together with the image. Therefore, undesired surface treating agent around the image is not retransferred to the image-receiving material.

24 Claims, 2 Drawing Sheets

IMAGE RETRANSFER SHEET FOR DRY-PROCESSING TYPE IMAGE-TRANSFER ONTO AN IMAGE RECEIVING SHEET

FIELD OF THE INVENTION

The present invention relates to an image-retransfer sheet on which characters, symbols, figures, etc. are thermally printed and from which the thermally transferred characters, symbols, figures, etc. are retransferred onto a surface of an image-receiving material with pressure, more particularly to an image-retransfer sheet which is a base sheet for an image-transferring material having an image provided by printing characters, symbols, figures, etc. using a heat-sensitive image-transferring type printer, typewriter, word processor or the like.

BACKGROUND OF THE INVENTION

A base sheet for dry processing type image-transferring materials which have an image printed by a thermal image-transferring process is described in U.S. Pat. No. 4,870,427. In the patent, a polyethylene film, a polypropylene film and a fluorine-based resin film having a smooth surface and exhibiting a contact angle with water of at least 95°, and paper, metal foil or plastic films having a release coating of a silicone resin are used as a base sheet.

In order to thermally print an image onto the base sheet having a contact angle with water of at least 95° and particularly not less than 105° it is necessary to reduce the surface tension of the ink to wet the sheet and it is further necessary to increase adhesion between the ink and the sheet more than the cohesive force of the ink and the adhesion between the ink and the sheet of an ink releasing material, such as polyethylene terephthalate film, on which the ink is carried. To achieve this result, the ink temperature must be increased when the image is thermally printed, requiring high energy to be applied to a thermal image-transferring device, which is disadvantageous from the standpoints of durability of a thermal head and load on a power supply.

Further, an image thermally printed on the base sheet having poor wettability is easily retransferred with slight pressure due to weak adhesion to the base sheet. So, a portion of the image which is desired to be left on the base sheet is unintentionally retransferred, causing stains on an image-receiving material. Such easy transfer is also troublesome in handling of the base sheet.

Furthermore, since the base sheet has an extremely small static friction coefficient, the sheet is not easily fixed during retransfer of the thermally printed image from the sheet to an image-receiving material. Therefore, the image is retransferred onto an undesired portion of the image receiving material or distorted on the image receiving material.

Japanese Laid-Open Patent Publication No. 63-246298 discloses formation of a sticky layer apart from a thermally printed image on a base sheet so as to prevent the sheet from moving during retransfer of the image with pressure.

However, the formation of a sticky layer on a certain portion of the base sheet necessitates a specific means in production and an exclusive device therefore, requiring large costs. Further, the sticky layer has to be covered with a separable sheet before use, i.e., before the image retransfer step, which requires additional means and costs. Moreover, in the case of a base sheet having a release coating of a silicone resin, the base sheet is coated twice for the release coating and the sticky layer. Regardless of the coating order of the two, the later coating may have chance to be affected by the previous coating.

That is, when a silicone resin is first coated on the sheet, the subsequent coating of a sticky composition is repelled. When the sticky composition is first coated, on the other hand, the silicone resin is coated only with difficulty because of the stickiness of the previous coating. If the sticky layer is covered with a separable sheet, then the thickness of the resulting sheet partially increases so that the silicone resin cannot easily be coated. Even if the above processing works properly to coat the silicone resin, since the sticky layer is provided only at a certain portion of the sheet and not around images thermally printed on the sheet, the sheet still moves during the image-retransfer step resulting in formation of imperfect images on the image-receiving material.

Surface treating agents such as, for example, release coating used in conventional image-retransfer sheets, are to improve the property of retransferring an ink image from the base sheets, and they are not transferred to an image-receiving material with the ink image in all cases. Therefore, the image-retransfer sheets necessarily have poor wettability so as to reduce adhesion between the sheet and the ink image. Because of this feature of such image-retransfer sheets, however, the sheets suffer from various problems such as reduced capability in receiving an ink image thermally printed or transferred from an ink ribbon, increased energy needed for thermally transferring an ink image, and poor resistance to friction of an ink image thermally transferred.

In order to solve the above-mentioned problems, Japanese Laid-Open Publication No. 2-81684 and No. 2-88294 disclose a retransfer sheet by which an ink image is retransferred to a image-receiving material together with a layer of a surface treating agent. The retransfer sheet is comprised of a substrate and a layer of a surface treating agent coated on the substrate.

However, when an image on the image-retransfer sheet is retransferred to the image-receiving material with a layer of a surface treating agent, there are problems mentioned below. When the image-retransfer sheet is put on the image-receiving material and pressure is applied onto the image to be retransferred on the image-retransfer sheet by an operator, an undesirable surface treating agent around the image may be retransferred to the image-receiving sheet. This problem is not so serious if the surface treating agent is colorless.

However, if coloring agents are added to the surface treating agent and portions of such surface treating agents around the image are retransferred to the image-receiving material, lines of the image retransferred to the image-receiving material with pressure become too bold or the retransferred image may be distorted. As a result, it becomes difficult to recognize the form of the image.

SUMMARY OF THE INVENTION

The object of the present invention is to provide an image-retransfer sheet capable of transferring only surface treating agent overlapped with an image formed on the image-retransfer sheet onto an image-receiving material and not transferring undesirable surface treating agents around the image.

An image-retransfer sheet for dry-processing type image-transfer onto an image receiving sheet comprises a substrate, a first layer formed by a surface treating agent on the substrate, and a second layer formed of a thermoplastic synthetic resin film on the first layer.

When an image-retransfer sheet of the present invention constructed as above is in use, ink on an ink ribbon is melted selectively by heat according to an image, heat is transferred to the second layer by the melted ink, holes are made through the second layer corresponding to the image and the ink can reach the first layer. When the resulting dry transfer material is transferred with pressure from the image-retransfer sheet to the image-receiving material, only the portions of the first layer overlapped with the holes are transferred to the image-receiving material together with the ink.

DETAILED DESCRIPTION OF THE INVENTION

A preferred embodiment of the present invention will be described in detail referring to accompanying drawings.

Figure 1:
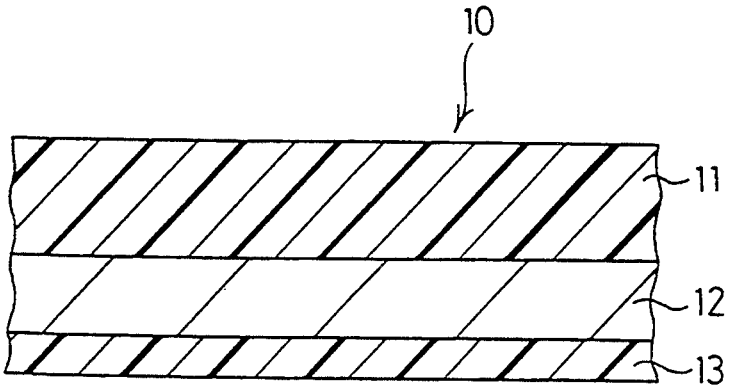
FIG. 1 is a cross sectional view of an image-retransfer sheet of the embodiment.

As shown in FIG. 1, an image-retransfer sheet 10 of the present invention comprises a substrate 11 having a layer 12 of a surface treating agent (hereafter referred to as a "surface treating layer") and a layer 13 of a thermoplastic synthetic resin film (hereafter referred to as a "thermoplastic synthetic resin film layer") on one surface thereof.

The substrate 11 preferably have a thickness ranging from 25 to 200 micrometers and more preferably from 50 to 150 micrometers. It is preferred that the substrate 11 has a mechanical strength sufficient to be handled in production of the image-retransfer sheet 10. It is also preferred that the substrate 11 has flexibility to such an extent that pressure can easily act upon an ink image on the sheet 10 during the step of retransferring the image with pressure and that a dry processing type image-transferring material can be easily produced by thermally printing on the sheet 10.

However, a substrate 11 which exhibits too large elongation is not preferred since the substrate 11 is stretched too much when applied pressure for retransfer of the ink image, causing distortion of the image. The substrate 11 preferably has elongation of not more than 200%.

To visually ensure retransfer of the ink image precisely onto an image-receiving material with pressure, the substrate 11 is preferably transparent or semi-transparent. A semi-transparent substrate is particularly preferred since it is easy to check whether or not the ink image is completely retransferred from the image-retransfer sheet 10.

Examples of the substrate 11 having the above properties include paper, metal foil, and plastic film such as fluorinated films of fluorine-containing resins (e.g., ethylene/tetrafluoroethylene copolymer, and tetrafluoroethylene/hexafluoroethylene copolymer), films of polyethylene, polypropylene, polyethylene terephthalate, polyamide, polyimide, polyvinyl chloride, polycarbonate, polysulfone, ethylene/vinyl acetate copolymer, acrylonitrile/butadiene/styrene copolymer or ionomer, and the like.

The surface treating layer 12 which is formed on one surface of the substrate 11 has tensile strength of from 1 to 100 kg/cm$^2$. This property is required so as to retransfer a thermally printed ink image together with the underlying surface treating agent onto an image-receiving material. That is, when the tensile strength exceeds 100 kg/cm$^2$, the cohesive force of the surface treating agent is too strong, resulting in formation of a tough film which cannot be transferred merely by applying pressure. When it is less than 1 kg/cm$^2$, on the other hand, the film strength of the resulting layer is so weak that the layer is peeled in pieces when the image retransfer sheet is folded.

It is preferred that the surface treating agent has a melting or softening point of at least 100°, or a melt viscosity at 100° C. of at least 1000 poises. When a material which melts or becomes markedly soft below 100° C. is used as a surface treating agent, the surface treating layer 12 melts upon thermal printing of an ink image on the sheet 10 and exhibits increased adhesion to the substrate 11, deteriorating the image-retransferring property.

Use of a surface treating agent having the above specified tensile strength, melting or softening points, etc. of the present invention makes it possible to retransfer the surface treating layer 12 together with an thermally printed ink image.

The advantages of the present invention due to retransfer of an printed ink image together with the surface treating agent are:

(i) the ink image can be completely retransferred without any residual ink on the substrate 11, (ii) it is easy to check whether or not the ink image is retransferred, and (iii) the surface treating agent transferred with the ink image functions as a protective layer so that the resistance to friction of the retransferred image is improved.

Moreover, thermoplastic synthetic resin film layer 13 disposed on the surface treating layer 12 prevents undesirable surface treating agent around an image from being retransferred to an image-receiving material and makes it possible to retransfer precisely only the surface treating agent underlying an ink image to the image-receiving material. Preferably the thermoplastic layer 13 is a film that has been stretched, for purposes of orientation and/or thinning.

Next, transfer of an image to an image-retransfer sheet 10 which has an extended thermoplastic synthetic resin film layer 13 on the surface treating layer 12 and retransfer of an image on the image-retransfer sheet 10 onto an image-receiving material will be explained.

Figure 2:
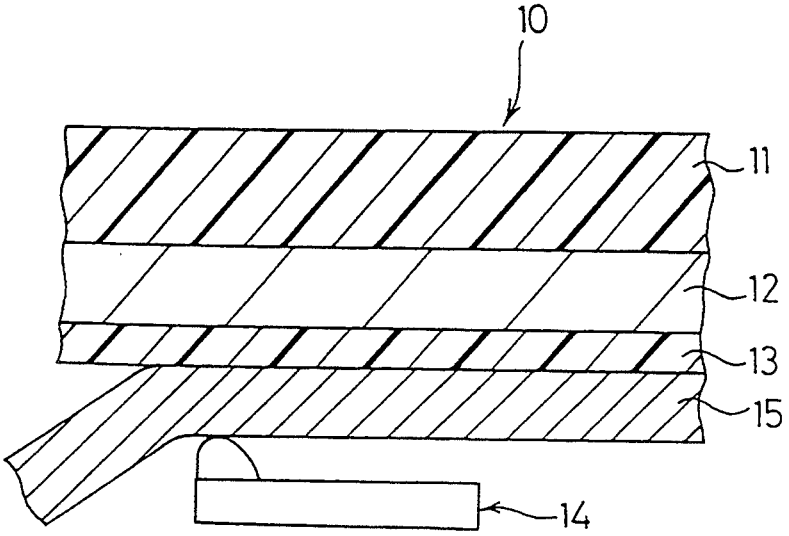
FIG. 2 shows thermal transfer of an image to an image-retransfer sheet of the embodiment.

As shown in FIG. 2, an ink ribbon 15 is disposed facing a thermal head 14 and an image-retransfer sheet 10 is disposed so that the thermoplastic synthetic resin film layer 13 faces the opposite side of the ink ribbon 15 facing the thermal head 14.

Figure 3A:
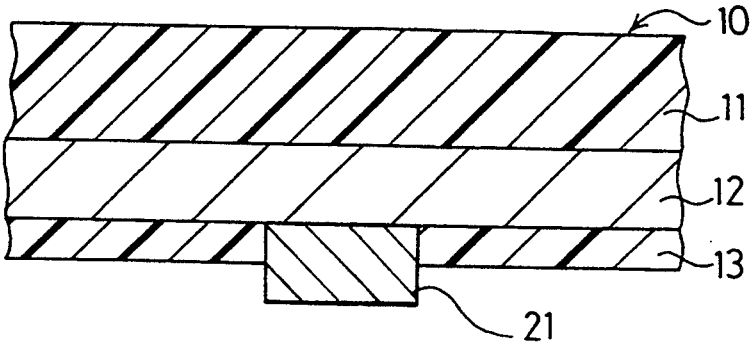
FIG. 3A shows an image-retransfer sheet of the embodiment with an ink image transferred thereto.

Ink of the ink ribbon 15 is melted selectively by heat from the thermal head 14 according to an image to be transferred. When the heated ink is transferred to the extended thermoplastic synthetic resin film layer 13, the material forming film layer 13 melts and holes are made through the thermoplastic synthetic resin film layer 13 corresponding to the ink image. As a result, the ink 21 reaches the surface treating layer 12 and the image is formed by a dry processing type image-transferring material on the image-retransfer sheet 10 as shown in FIG. 3A.

Heat energy transferred from the thermal head 14 to the image-retransfer sheet 10 is as same as the heat energy transferred from the thermal head of a general printing device which is from 1 to 50 mj/mm$^2$. The heat energy from 15 to 30 mj/mm$^2$ is more preferable since it is suitable for forming holes in many of the materials usable to for thermoplastic synthetic resin film 13 and also it is suitable for ink to be transferred to the image-retransfer sheet 10 from the ink ribbon 15.

Figure 3B:
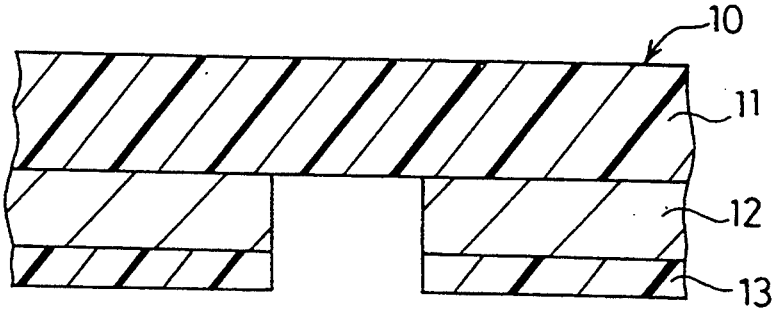
FIG. 3B shows an image-retransfer sheet of the embodiment with an ink image retransferred therefrom.
Figure 3C:
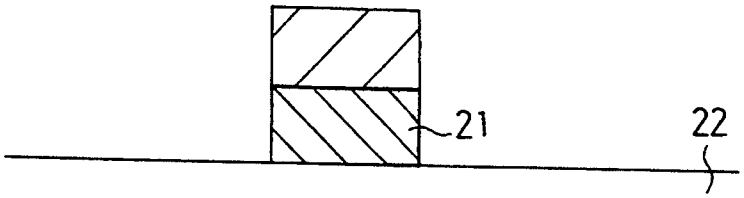
FIG. 3C shows an image-receiving material with an ink image retransferred thereon from an image-retransfer sheet.

If the above-mentioned image-retransfer sheet 10 is put on an image-receiving material and pressure is applied to the image-retransfer sheet 10 by an operator, only the surface treating agent beneath the holes of the thermoplastic synthetic resin film layer 13 is retransferred to the image-receiving material 22 together with the ink image 21, as shown in FIG. 3B and FIG. 3C. Therefore, even if high pressure is applied to the image-retransfer sheet 10 by the operator, only the surface treating agent beneath the holes is retransferred to the image-receiving material 22 together with the ink image 21 and retransfer of undesirable surface treating agent around the ink image 21 can be prevented.

The surface treating layer 12 of the present invention is mainly composed of one or more of surface treating agents exemplified with resins such as polyethylene, ethylene/vinyl acetate copolymer, vinyl chloride/vinyl acetate copolymer, polyvinyl butyral, celluloses, ethylene/ethyl acrylate copolymer, ethylene/acrylic acid copolymer, inonomer, ethylene/methacrylic acid copolymer, polyvinyl alcohol, polyvinyl pyrrolidone and the like.

One or more waxes such as polyethylene wax, montan wax, Fischer-Tropsch wax and synthetic wax can be added to the surface treating agent or can be a substitute for resin. Wax is preferably one component of the surface treating layer because the tensile strength of the layer can be finely adjusted by controlling the amount of wax added, whereby a wide variety of materials can be used as a surface treating agent and in addition, the image-retransferring property can be markedly improved. If color or pigment is added to the surface treating agent, an image retransferred to an image-receiving material can obtain enough covering power in spite of ink of weak covering power.

When the above-described resins are used as main components of the surface treating layer 12, they are preferably used in the form of fine dispersion such as an emulsion and a suspension instead of being dissolved in a solvent or hot-melted which increases the tensile strength too much. The surface treating layer 12 may also contain fillers to control its tensile strength and adhesion.

Examples of the thermoplastic synthetic resin film layer 13 include polyvinyl chloride film, vinylidene chloride/vinyl chloride copolymer film, vinylidene chloride film, polypropylene film, propylene/ethylene copolymer film, polyethylene terephtalate (PET) film, vinyl acetate/ethylene copolymer film, polystyrene film and the like. The thickness of the thermoplastic synthetic resin film layer 13 preferably ranges from about 1 to about 8 micrometers, so that a hole is easily made through the thermoplastic synthetic resin film layer 13 when heat energy provided from a thermal head of a general printing device to an image-retransfer sheet is from 1 to 50 mj/mm$^2$ more preferably from 15 to 30 mj/mm$^2$.

Therefore, at least one of a melting point and a softening point of the thermoplastic synthetic resin film layer 13 has a relationship with the thickness of the layer and the heat energy applied thereto to easily make a precise hole on the layer 13. The melting point of polyethylene terephtalate film is about 260° C. The softening point of polyvinyl chloride film is from 70° C. to 80° C. The melting point of vinylidene chloride is about 200° C.

In particular, polyester resin such as polyethylene terephtalate (PET) or vinyl resin such as polyvinyl chloride, vinylidene chloride/vinyl chloride copolymer and vinylidene chloride are desirable because a thermoplastic synthetic resin film 13 consisting of or comprised of either one of above mentioned resins is particularly strong, adheres well to the surface treating layer 12 and, with a thickness ranging from 1 to 8 micrometers is easily holed when heat energy provided from the thermal head is from 1 to 50 mj/mm$^2$, and more preferably from 15 to 30 mj/mm$^2$. Since polyethylene terephtalate (PET) film especially exhibits the desirable features mentioned above, it is most preferable material to use for the thermoplastic synthetic resin film.

The image-retransfer sheet with the thermoplastic resin film layer 13 which is attached to the substrate 11 of the image-retransfer sheet 10 by the adhesive strength of the surface treating layer 12 itself or an adhesive agent has advantages as follows;

(i) properties of thermally transferring an image, retransferring the image, resistance to friction and adhesion of the image to the image-retransfer sheet 10 during handling are good.

(ii) the image-retransfer sheet 10 is fixed during retransfer of images to an image-receiving material 22.

(iii) it is possible to check whether or not the image is retransferred to the image-receiving material 22 easily and precisely.

(iv) an image retransferred to the image-receiving material has a good resistance to friction.

(v) images can be transferred to the image-retransfer sheet 10 using the thermoplastic synthetic resin film by a general printing device.

Any ink ribbon conventionally used in a heat-sensitive image-transferring type printer, typewriter, word processor, etc. may be used for thermally forming an image on the image-retransfer sheet 10 of the present invention. Ink ribbons may be those have a coating of ink mainly composed of wax.

However, ink ribbons may be preferably those having a layer for controlling image transferring properties. The layer is provided on the ink layer as a top coating and has high heat-sensitive adhesion, hardness, viscosity and cohesion, as compared to the ink layer, whereby the thermal transferring property of the ink ribbon, particularly to an image-retransfer sheet having poor wettability, is enhanced. These layers of the ink image thermally transferred on an image-retransfer sheet are retransferred together onto an image-receiving material when pressure is applied. If a pressure-sensitive adhesive property is imparted to the ink layer, the pressure-sensitive image-retransferring property can further be improved.

It is possible that a colored or hypochromic (i.e., partly colored) surface treating agent can be used to form images on an image-receiving material instead of an ink ribbon. In this case, holes are made through the extended thermoplastic synthetic resin film layer 13 by heat from the thermal head 14 corresponding to images and the colored surface treating agent is transferred to the image-receiving material through the holes if pressure is applied by an operator. As a result, images are transferred to the image-receiving material.

The present invention is further explained in detail with reference to the following Example, but the present invention is not to be construed as being limited thereto.

EXAMPLE

After the composition for a surface treating agent described below was coated on a 50 micrometer thick polyethylene terephthalate film and dried, a smooth surface treating layer was formed having a contact angle with water of 76° and a static friction coefficient of about 0.77. The surface treating layer had a tensile strength of about 20 kg/cm$^2$ and a melt viscosity at 150° C. of about 4000 to 5000 poises. In the Example, all parts are by weight.

| Composition for Surface Treating Layer: | |
|---|---|
| ionomer ("Chemipearl SA-200", produced by Mitsui Petrochemical Industries, Ltd.) | 70 parts |
| titanium oxide ("Tipaque A-100", produced by Ishihara Sangyo Kaisha, Ltd.) | 30 parts |

Next, a 3 micrometer vinylidene chloride/vinyl chloride copolymer resin film (having a thermal shrinkage percentage in the vertical direction of 5.3% and in the horizontal direction of 3.4% when the material is kept in hot water of 100° C. for 3 minutes) was disposed on the above-mentioned sheet and sealed with heat, resulting in an image-retransfer sheet.

The term "thermal shrinkage" relates to the amount of shrinkage the thermoplastic film undergoes, measured along two perpendicular axes, when a predetermined amount of heat energy is applied for a predetermined amount of time. The resulting amount of shrinkage is the thermal shrinkage percentage. It is desirable to have relatively low thermal shrinkage values for the thermoplastic resin film 13 so that the holes formed in the layer by melting do not become unduly large. However, it is not easy to make a hole on the layer 13 of the thermoplastic resin film if the thermoplastic resin film has a quite low shrinkage percentage. The desirable range of thermal shrinkage percentage of the materials for the thermoplastic synthetic resin film layer 13 is from 0.5% to 50%. For example, the desirable shrinkage percentage of vinylidene chloride is from 0.5% to 30% when the material is kept in hot water of 100° C. for 3 minutes. The desirable shrinkage percentage of polyethylene terephtalate is from 0.5% to 10%. The figures are obtained by means of JIS 2318 (JIS stands for Japanese Industrial Standard). The desirable shrinkage percentage of polyvinyl chloride is from 0.5% to 50%. The figures are obtained by means of JIS K-6734.

White ink was thermally transferred to the image-retransfer sheet by a heat sensitive word processor and a dry image-transferring material with desired images to be transferred was obtained. When the ink image of the dry image-transferring material was retransferred to an image-receiving material, such as paper and plastic articles, by applying pressure thereto, a clear white retransferred image with sufficient covering power was formed on the image receiving material. Undesired surface treating agent around the ink image was not transferred to the image-receiving material.

Because the surface treating agent was transferred together with the ink image, it was easy to check visually whether or not the image retransfer was completed and the resulting retransferred image covered with the surface treating agent exhibited good resistance to friction.

On the other hand, another dry image-transferring material was obtained in the same way as the example using an image-retransfer sheet of the example without an extended thermoplastic synthetic resin film layer. The image of the resulting dry image-transferring material was transferred to the image-receiving material by applying pressure. As a result, since undesired surface treating agent around the image was transferred to the image-receiving material, lines of the retransferred image became so bold that it was difficult to recognize the details of the image.

As explained above, the image-retransfer sheet 10 of the embodiment makes it possible to retransfer only the surface treating agent overlying the image formed on the image-retransfer sheet 10 and not to retransfer undesired surface treating agent around the image.

It is to be understood that the present invention is not restricted to the particular forms shown in the foregoing embodiment. Various modifications and alterations can be made thereto without departing from the scope of the inventions encompassed by the appended claims.

What is claimed is:

1. An image-retransfer sheet for dry-processing type image-transfer onto an image receiving sheet comprising:

a substrate;

a first layer formed of a surface treating agent on the first surface of said substrate, the first layer being capable of receiving a thermally transferred ink image thereon and having a tensile strength ranging from about 1 to about 100 kg/cm$^2$; and a second layer formed of a thermoplastic synthetic resin film on said first layer, wherein holes are formed in the resin film as the first layer receives a transferred ink image.

2. An image-retransfer sheet as claimed in claim 1, wherein said second layer includes a material selected from the group consisting of vinyl resin and polyester resin.

3. An image-retransfer sheet as claimed in claim 1, wherein a thickness of said second layer depends on the material forming the thermoplastic synthetic resin film and the heat energy to be provided to the image-retransfer sheet.

4. An image-retransfer sheet as claimed in claim 3, wherein at least one of a melting point and a softening point of said second layer is related to a thickness of said second layer and heat energy to be applied to said second layer.

5. An image-retransfer sheet as claimed in claim 4, wherein said second layer comprises a component selected from the group consisting of vinyl resin and polyester resin.

6. An image-retransfer sheet as claimed in claim 5, wherein said vinyl resin comprises a component selected from the group consisting of polyvinyl chloride, a copolymer of vinylidene chloride and vinyl chloride, and vinylidene chloride.

7. An image-retransfer sheet as claimed in claim 5, wherein the thickness of the second layer ranges from about 1 to about 8 micrometers and the second layer melts when heat energy ranging from 1 to 50 mj/mm$^2$ is provided to the image-retransfer sheet.

8. An image-retransfer sheet as claimed in claim 7, wherein the second layer melts when heat energy ranging from 15 to 30 mj/mm$^2$ is provided to the image-retransfer sheet.

9. An image-retransfer sheet as claimed in claim 1, wherein said substrate is semi-transparent.

10. An image-retransfer sheet as claimed in claim 1, wherein said substrate is transparent.

11. An image-retransfer sheet as claimed in claim 10, wherein a colored ink image is disposed on the image retransfer sheet and said first layer is the same color as the ink image.

12. An image-retransfer sheet as claimed in claim 1, wherein said first layer is colored.

13. An image-retransfer sheet as claimed in claim 12, wherein said second layer comprises a polyester resin.

14. An image-retransfer sheet as claimed in claim 1, wherein said substrate has a second surface which is opposite to the first surface, and wherein the thermally transferred ink image is transferred to the image receiving sheet by application of pressure to the second surface of said substrate.

15. An image-retransfer sheet as claimed in claim 14, wherein the first layer surface treating agent that receives the ink image is transferred onto the image receiving sheet with the ink image.

16. An image-retransfer sheet for dry-processing type image-transfer onto an image receiving sheet comprising:

a substrate having a first surface;

a first layer formed of a surface treating agent disposed on the first surface of said substrate, the first layer being capable of receiving a thermally transferred ink image thereon and having a tensile strength ranging from about 1 to about 100 kg/cm$^2$; and a second layer formed of a thermoplastic synthetic resin film disposed on said first layer, wherein holes are formed in the resin film as the first layer receives a transferred ink image, said second layer including a component selected form the group consisting of vinyl resin and polyester resin, said second layer having a thickness ranging from about 1 to about 8 micrometers, so as to be melted when a heat energy ranging from 15 to 30 mj/mm$^2$ is provided to the image-retransfer sheet.

17. An image-retransfer sheet as claimed in claim 16, wherein said substrate is semi-transparent.

18. An image-retransfer sheet as claimed in claim 17, wherein said first layer is one of colorless, white and hypochromic.

19. An image-retransfer sheet as claimed in claim 17, wherein said first layer is colored.

20. An image-retransfer sheet as claimed in claim 16, wherein said substrate is transparent.

21. An image-retransfer sheet as claimed in claim 16, wherein said substrate has a second surface which is opposite to the first surface, and wherein the thermally transferred ink image is retransferred to the image receiving sheet by application of pressure to the second surface of said substrate.

22. An image-retransfer sheet as claimed in claim 21, wherein the first layer surface treating agent that receives the ink image is transferred onto the image receiving sheet with the ink image.

23. An image-retransfer sheet for dry-processing type image-transfer onto an image receiving sheet using an ink ribbon comprising:

a semi-transparent substrate having a first surface;

a first layer formed of a surface treating agent disposed on the first surface of said substrate, said first layer being capable of receiving a thermally transferred ink image thereon and having a tensile strength ranging from about 1 to about 100 kg/cm$^2$, said first layer being one of colorless, white and hypochromic; and a second layer formed of a thermoplastic synthetic resin film disposed on said first layer, wherein holes are formed in the resin film as the first layer receives a transferred ink image, said thermoplastic synthetic resin being selected from the group consisting of vinyl resin and polyester resin, said second layer having a thickness ranging from about 1 to about 8 micrometers, so as to be melted when a heat energy ranging from 15 to 30 mj/mm$^2$ is provided to the image-retransfer sheet.

24. An image-retransfer sheet as claimed in claim 23, wherein said substrate has a second surface which said opposite to the first surface and a thermally transferred ink is disposed on the first layer as a result of said second layer being melted by the thermally transferred ink, thereby creating an image to be retransferred onto the image receiving sheet together with said first layer by application of pressure to the second surface of said substrate.

* * * * *